US007596878B2

(12) United States Patent
Mailloux

(10) Patent No.: US 7,596,878 B2
(45) Date of Patent: Oct. 6, 2009

(54) TOOL FOR TRACING HORIZONTAL LINES ON CURVED SURFACES

(76) Inventor: Gaetan Mailloux, 58, Des Noyers, St-Remi, Quebec (CA) J0L 2L0

( * ) Notice: Subject to any disclaimer, the term of this patent is extended or adjusted under 35 U.S.C. 154(b) by 0 days.

(21) Appl. No.: 12/235,990

(22) Filed: Sep. 23, 2008

(65) Prior Publication Data

US 2009/0077821 A1 Mar. 26, 2009

Related U.S. Application Data

(60) Provisional application No. 60/974,619, filed on Sep. 24, 2007.

(51) Int. Cl.
*B43L 13/00* (2006.01)

(52) U.S. Cl. ..... 33/561.2; 33/21.1

(58) Field of Classification Search ..... 33/561.1, 33/561.2, 561.3, 425, 427, 451, 452, 21.1, 33/27.01, 27.03
See application file for complete search history.

(56) References Cited

U.S. PATENT DOCUMENTS

| | | | | |
|---|---|---|---|---|
| 923,875 | A * | 6/1909 | McDonald | 33/529 |
| 962,896 | A * | 6/1910 | Gasparich | 33/561.3 |
| 1,007,992 | A * | 11/1911 | Van Gilder | 33/561.2 |
| 1,411,151 | A * | 3/1922 | Becker | 33/561.2 |
| 1,953,283 | A * | 4/1934 | Weston | 33/561.2 |
| 2,522,030 | A * | 9/1950 | Fuqua | 33/561.3 |
| 5,131,164 | A * | 7/1992 | Miller | 33/613 |
| 5,560,116 | A * | 10/1996 | Tobia | 33/365 |
| 5,651,184 | A * | 7/1997 | Tutty | 33/21.1 |
| 5,881,468 | A * | 3/1999 | Baumann | 33/383 |
| 2001/0029679 | A1* | 10/2001 | Peters | 33/561.3 |
| 2004/0250433 | A1 | 12/2004 | Zugel | |

FOREIGN PATENT DOCUMENTS

| | | |
|---|---|---|
| EP | 1630522 | 3/2006 |
| WO | 9920978 | 4/1999 |

* cited by examiner

*Primary Examiner*—Yaritza Guadalupe-McCall

(57) ABSTRACT

A tool for tracing horizontal lines on curved surfaces configured so that it can receive two spirit levels and a slider to allow for one level to push against a ruler so as to give the ruler a curvature similar to that of a wall.

1 Claim, 3 Drawing Sheets

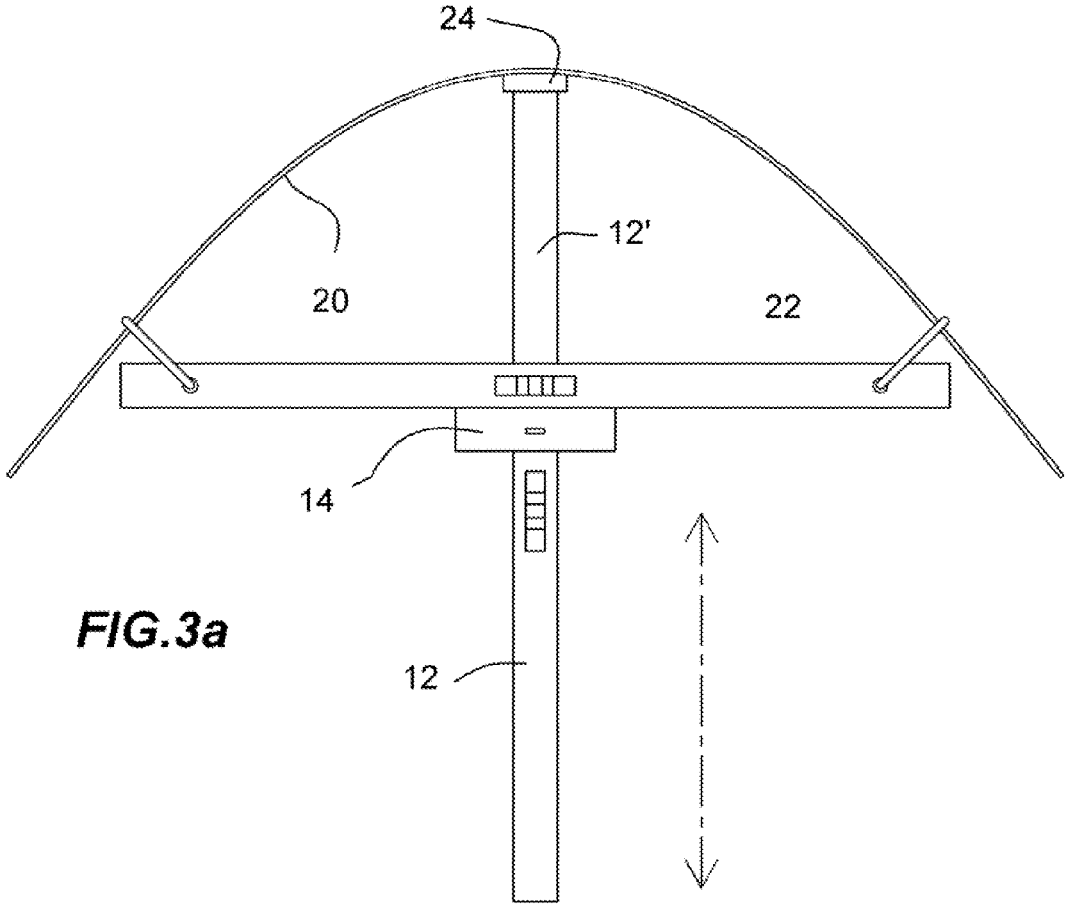
FIG.3a
FIG.3b
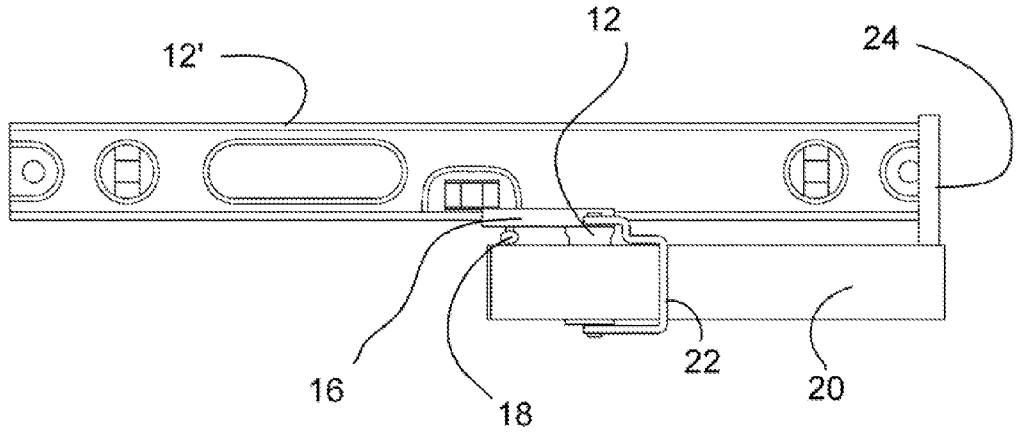

TOOL FOR TRACING HORIZONTAL LINES ON CURVED SURFACES

This application claims priority based on provisional application 60/974,619 filed Sep. 24, 2007

FIELD OF THE INVENTION

The present invention relates generally to hand tools but more particularly to leveling tools for curved surfaces.

BACKGROUND OF THE INVENTION

Spirit levels have been used for centuries. They can be used for getting a true horizontal or true vertical. Some can even give you 45 degrees while others have a rotating dial that can be set to any degree between 0 and 90. Some can get you an instant reading along two axes.

Levels are sometimes used as a ruler to trace straight horizontal or vertical lines so as to mark a surface for later treatment, such as for lining up wainscotting or wallpaper.

SUMMARY OF THE INVENTION

In view of the foregoing disadvantages inherent in the known devices now present in the prior art, the present invention, which will be described subsequently in greater detail, is to provide objects and advantages which are:

to provide for a hand tool that can allow a user to trace a straight, horizontal line on a curved surface by allowing for leveling on two perpendicular axes simultaneously.

To attain these ends, the present invention generally comprises a bracket configured so that it can receive a bottom level and a top level. Both the top level and the bottom level are set in a perpendicular relationship to each other by way of the bracket which is fixedly attached to the bottom level and slidingly attached to the top level by way of asliding groove. A wingnut secures the top level at a given position, relative to the bottom level. A resiliently deformable ruler is resiliently deformed by tthe top level pushing against it. A wingnut to tighten the top level in a set position within the slider. The ruler has its extremities retained by way of retainers so that the ruler can deform so as to create a bow shape. The ruler is attached to the top level by way of a pushing means.

The tool for tracing horizontal lines on curved surfaces has a method of use consisting in the steps of a user leans it against a curved wall, insures that the bottom level is level. The user then pushes the top level while keeping it level as well, until the ruler conforms to the curvature by touching the wall entirely. After verifying that both levels are still level, the wingnut is tightened.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 3*ab* Bottom and and side views, respectively.

DETAILED DESCRIPTION

Figure 1A:
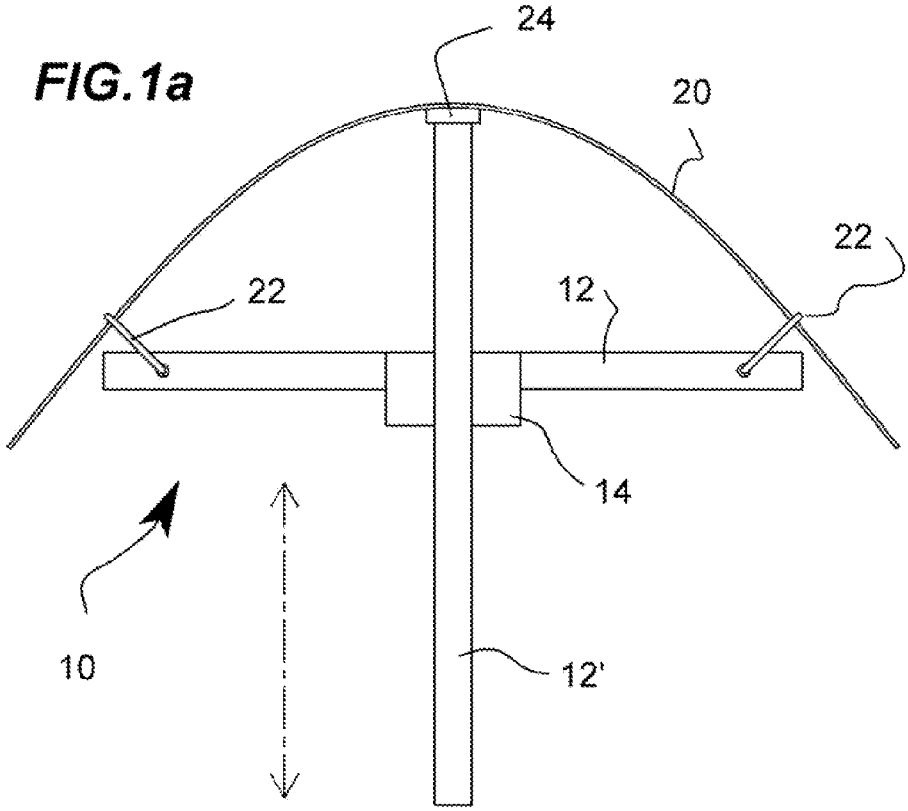
FIGS. 1*a-c* Top, rear and front views, respectively, of the invention.
Figure 1B:
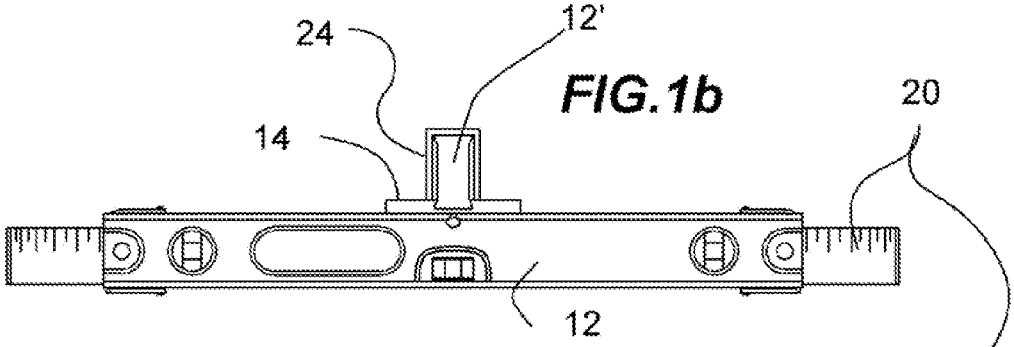
Figure 1C:
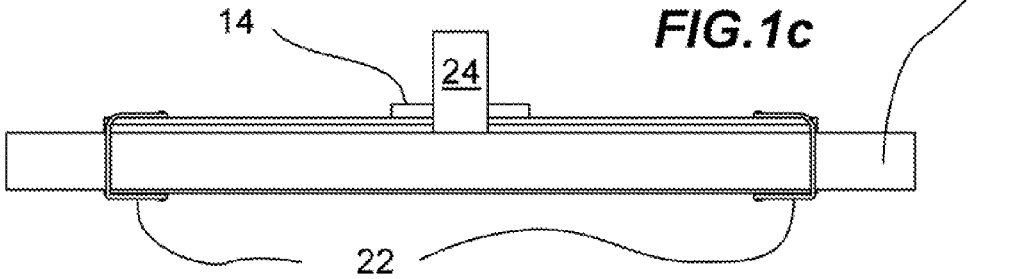
Figure 2:
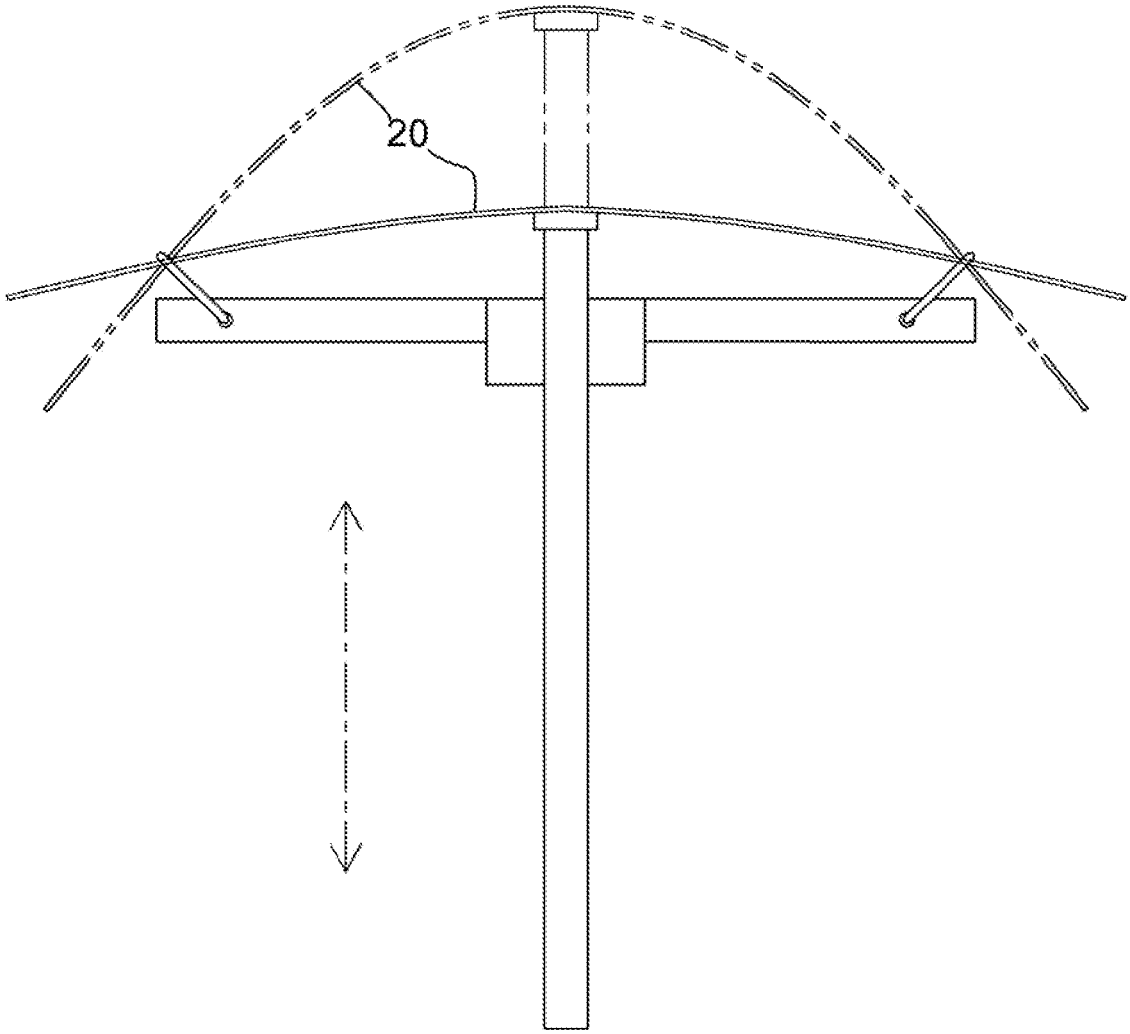
FIG. 2 Top view showing the flexibility.

A tool for tracing horizontal lines on curved surfaces (10) is comprised of a bracket (14) configured so that it can receive a bottom level (12) and a top level (12').

The two levels (12, 12') are set in a perpendicular relationship to each other by way of the bracket (14) which is fixedly attached to the bottom level (12) and slidingly attached to the top level (12'). by way of asliding groove (16). A wingnut (18) secures the top level (12') at a given position, relative to the bottom level (12).

By sliding on the top level (12') forward, it pushes against a resiliently deformable ruler (20). Once the ruler (20) matches the curvature of a given surface, the wingnut (18) is tightened and the top level (12') is locked in place. The ruler (20) has its extremities retained by way of retainers (22) which allow the ruler (20) to deform so as to create its bow shape.

The ruler (20) is attached to the top level (12') by way of a pushing means (24), which is necessary since the top level (12') is higher than the ruler (20), which is in line with the bottom level (12).

In order to use the tool for tracing horizontal lines on curved surfaces (10), a user leans it against a curved wall (not shown), insures that the bottom level (12) is level. The user then pushes the top level (12') while keeping it level as well, until the ruler (20) conforms to the curvature by touching the wall entirely. After verifying that both levels are still level, the wingnut (18) is tightened.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tool for tracing horizontal lines on curved surfaces having a method of use consisting in the steps of:

a user leans the tool against a curved wall;

insures that a bottom level is leveled;

using a top level connected to the bottom level by way of a bracket configured so that it can receive both the top level and the bottom level in a perpendicular relationship to each other by way of a bracket which is fixedly attached to the bottom level and slidingly attached to the top level by way of a sliding groove, the user puts the top level leveled and pushes the top level while keeping both the top level and the bottom level leveled until a resiliently deformable ruler is resiliently deformed by the top level pushing against the ruler the ruler is attached to the top level by way of a pushing means and has its extremities retained by way of retainers so as to be deformed so as to create a bow shape that conforms to the curvature by touching the curved wall entirely;

a wingnut tightens the top level at a given position within the slider and relative to the bottom level.

* * * * *